US005226562A

United States Patent [19]

Kirk

[11] Patent Number: 5,226,562

[45] Date of Patent: Jul. 13, 1993

[54] DISPENSER FOR GLUE CARTRIDGE

[76] Inventor: Norbert Kirk, 1458 Belle Plaine, Chicago, Ill. 60613

[21] Appl. No.: 758,890

[22] Filed: Sep. 11, 1991

[51] Int. Cl.[5] ..... B67D 5/00

[52] U.S. Cl. ..... 222/81; 222/192; 222/187; 222/509; 222/518

[58] Field of Search ..... 222/81, 83, 92, 107, 222/192, 187, 183, 105, 212, 215, 496, 501, 509, 513, 514, 518, 420–422; 215/257

[56] References Cited

U.S. PATENT DOCUMENTS

| | | | |
|---|---|---|---|
| 1,160,883 | 11/1915 | Hamer, Sr. | 222/422 |
| 1,533,358 | 4/1925 | West | 222/421 |
| 1,707,660 | 4/1929 | Hammerstein | 222/514 |
| 1,909,209 | 5/1933 | Miller | 222/81 |
| 4,146,152 | 3/1979 | Ogawa et al. | 222/81 |
| 4,271,982 | 6/1981 | Niksich et al. | 222/501 X |
| 4,681,243 | 7/1987 | Takasugi | 222/81 X |
| 4,723,687 | 2/1988 | Kutterer | 222/83 |
| 4,958,748 | 9/1990 | Otake | 222/420 X |
| 5,042,690 | 8/1991 | O'Meara | 222/187 X |
| 5,052,589 | 10/1991 | O'Meara | 222/83 |

FOREIGN PATENT DOCUMENTS

| | | | |
|---|---|---|---|
| 3712288 | 10/1987 | Fed. Rep. of Germany | 222/187 |

*Primary Examiner*—Kevin P. Shaver

*Attorney, Agent, or Firm*—McAndrews, Held & Malloy, Ltd.

[57] ABSTRACT

A dispenser for pin-sealed containers of cyanoacrylate glue and similar fluids includes a pin which engages an outlet aperture in a neck of the container. The pin is supported by other components of the dispenser to allow the user to extract the pin from the outlet aperture a sufficient amount to allow fluid flow without the user coming into contact with the fluid during the extraction of the pin.

33 Claims, 5 Drawing Sheets

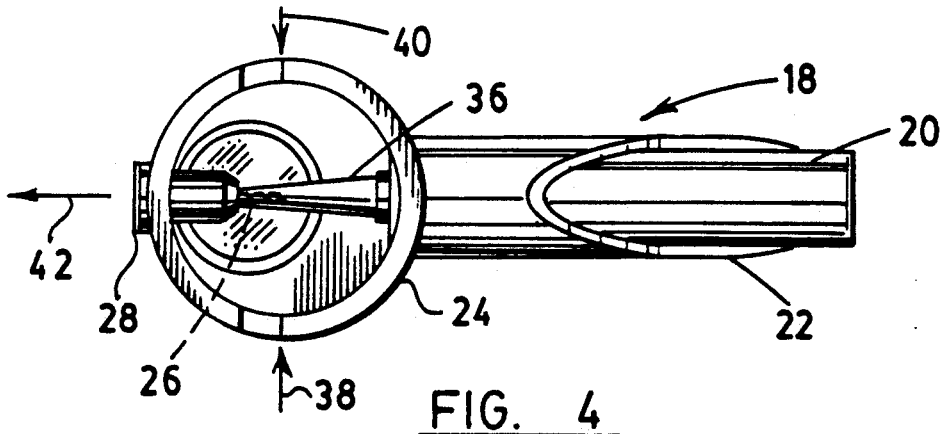
FIG. 4
FIG. 7
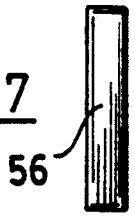
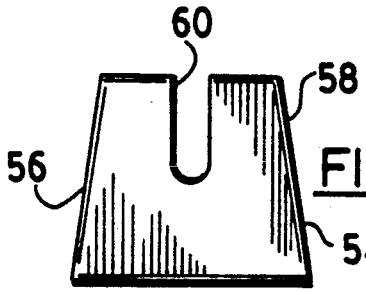
FIG. 8
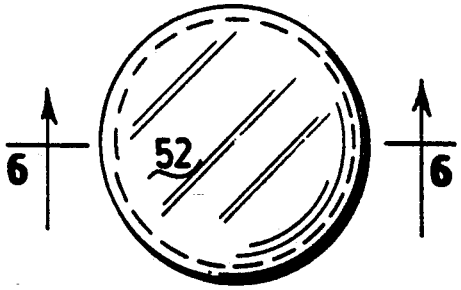
FIG. 5
FIG. 6
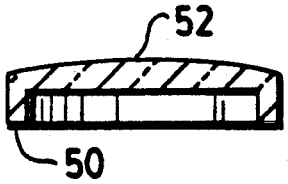

FIG. 9
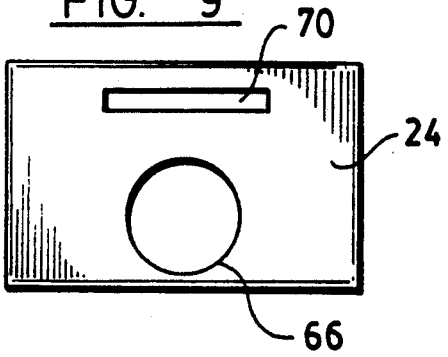
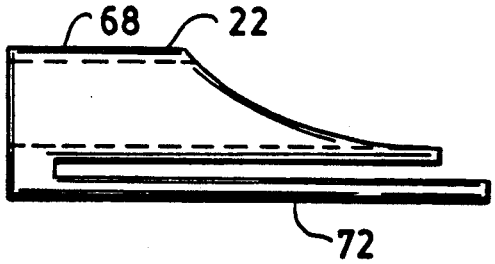
FIG. 10
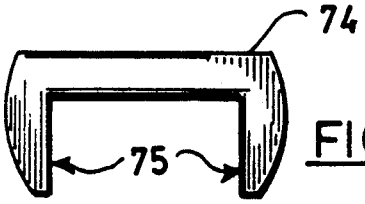
FIG. 11
FIG 14
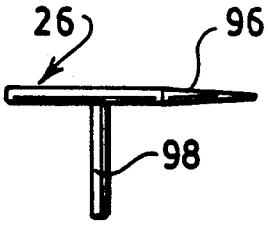
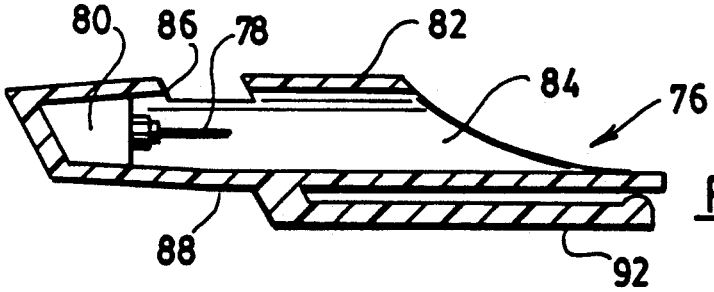
FIG. 12
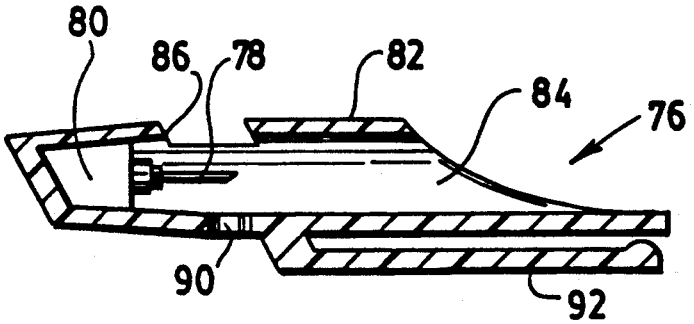
FIG. 13

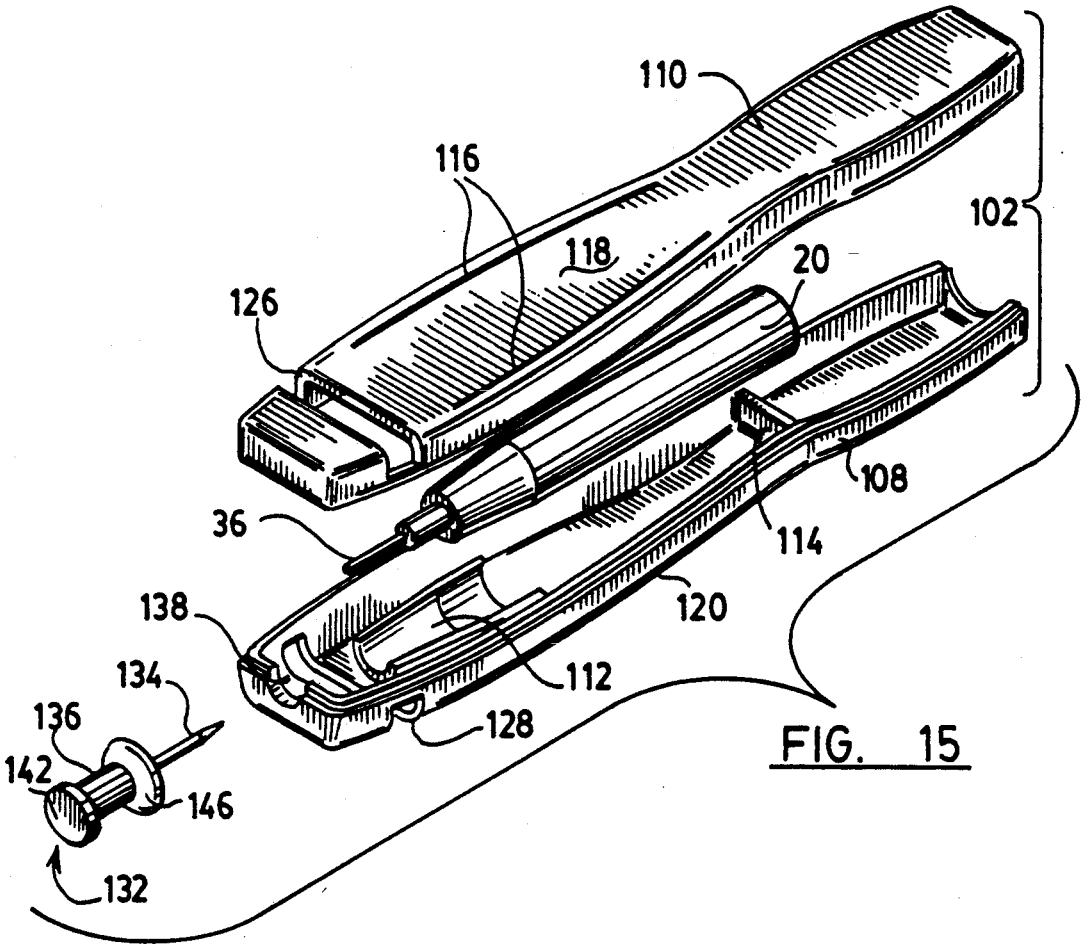
FIG. 15
FIG. 16
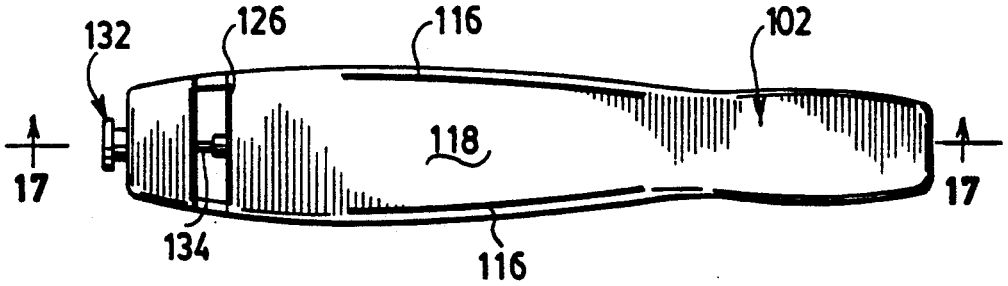
FIG. 17
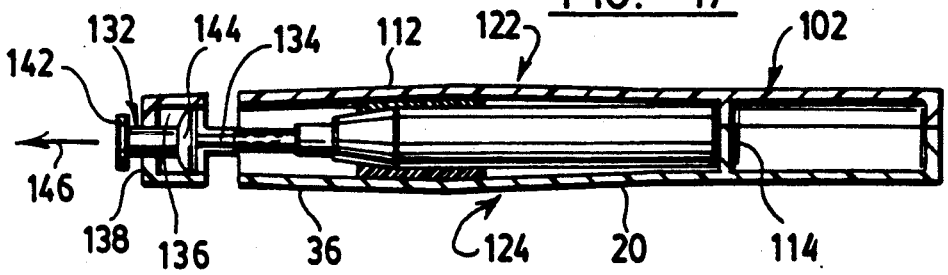

DISPENSER FOR GLUE CARTRIDGE

BACKGROUND OF THE INVENTION

This invention relates to dispensers for glue or the like. In particular, a dispenser is set forth that is easy to operate to dispense a substance such as a super glue. The dispenser may be opened and closed without the user coming into contact with the substance that is dispensed.

Many liquid products are available that are kept in containers for continual use. Many such products cure upon contact with the air and, therefore, need to be protected from the air when they are not being used. A particular example of such a liquid product is cyanoacrylate glue, also referred to as a super glue, such as one that is sold under the trademark KRAZY GLUE.

Fluids such as cyanoacrylate glue and the like are typically sold in tubes or containers that are sealed when they are sold. A piercing cap is supplied that includes a pin to pierce the seal of the cap to create an outlet aperture for the fluid. Upon piercing the seal, the pin is allowed to remain in the resulting outlet aperture to seal the fluid against exposure to the air. To dispense fluid, a user grips the cap between thumb and forefinger and pulls or twists it to remove the pin from the outlet aperture. The fluid is then squeezed or poured from the container to be used. After the fluid has been dispensed, the cap is replaced by returning the pin to the outlet aperture to make a seal. Such pin seals are used with dispensers of a number of fluids in addition to cyanoacrylate glue.

There are several disadvantages involved in the use of piercing caps such as those described above. One disadvantage is that a cap that is not attached to a container is easily misplaced. If the user does not find the cap in time to return it to make a seal after use, the container with all of its contents may become unusable through exposure to air. Another disadvantage of the removable piercing cap is that when it has once been used, especially with a container of glue or adhesive, the pin tends to get stuck in the hole. A user must then hold the container and the cap and apply a force to remove the pin from the outlet aperture. Often, a twisting motion is necessary. As the user removes the cap, it is easy to lose control of the cap and dispenser thereby exerting a force on the container that expels some of the liquid. This presents a risk of spilling some of the fluid if the user is not careful. It also presents a risk of getting some of the fluid on the fingers of the user as the user twists the cap. This is a particular threat with a cyanoacrylate glue since it bonds skin to skin and thus can injure the user who gets some of the cyanoacrylate glue on his or her fingers.

It is an object of the present invention to provide a better fluid dispenser.

It is a further object of the present invention to provide an attached cap for a pin-closed dispenser.

It is a further object of the present invention to provide a self-closing dispenser for a container of cyanoacrylate glue.

It is a further object of the present invention to provide a dispensing cap for a glue container that can be removed and re-inserted without exerting an expulsive force on the container.

It is a further object of the present invention to provide a dispenser for cyanoacrylate glue that keeps the fingers of a user away from the glue when the dispenser is used.

Other objects will become apparent in the course of a detailed description of the invention.

SUMMARY OF THE INVENTION

A dispenser for pin-sealed containers of cyanoacrylate glue and similar fluids is disclosed. The dispenser includes a hollow body for holding the tube or other container of glue. A pin cap is disposed in a substantially fixed relationship with the hollow body. The pin cap includes a pin which engages and pierces the neck of the tube or other container to form an outlet aperture through which fluid may be dispensed. The pin may be disengaged from the outlet aperture of the container without the user contacting the fluid in the region of the outlet aperture.

In one embodiment of the invention, the pin cap is disposed in fixed relationship to a resilient biasing member. The resilient biasing member is connected to the hollow body of the dispenser which holds the tube or other container of glue. The resilient biasing member of the disclosed embodiment is substantially cylindrical in shape and normally urges the pin of the pin cap into the outlet aperture to seal the tube when the biasing member is in its relaxed state. When the biasing member is squeezed, it deforms to apply a force between the pin and the tube that withdraws the pin from the tube a sufficient distance to permit a flow of glue. The biasing member is open in a plane that is substantially parallel to the axis of the tube to allow the glue to drip on a surface. A guide groove may be provided in the biasing member to assist the user in dispensing the glue along an edge of an article. An end of the biasing member opposite to the open end may itself be open, closed, or filled with a magnifying lens to help the user place a drop of glue.

A removable wedge protects the biasing member from being squeezed during shipping or at any other time when the flow of glue is not desired. This function may also be performed by a cover that can be placed on the biasing member to keep it from being squeezed. A clip can be attached to the biasing member to hold it in the open position.

In a second embodiment, a hollow body is employed for holding the tube. The hollow body has a substantially open region in which the tube is exposed. This allows application of a dispensing force to the tube in the exposed region. The hollow body also has an application aperture proximate the outlet aperture of the tube to apply fluid flowing from the outlet aperture to the surface that is to be glued. A pin cap is connected to the holder proximate the neck of the tube. The pin cap has a pin extending therefrom to engage the outlet aperture of the tube. To withdraw the pin from the outlet aperture, the user grips the dispenser and withdraws the tube from the dispenser to cause the pin to be disengaged from the outlet aperture a sufficient amount to allow fluid to flow therethrough. The user may then apply a dispensing force to the tube to cause fluid to exit the outlet and application apertures and onto the surface to be glued.

In a third embodiment, a resilient hollow body is employed for holding the tube. The resilient hollow body includes an application aperture proximate the outlet aperture of the tube and is resiliently deformable to allow application of a dispensing force to the tube. A pin cap is disposed in an aperture within the resilient hollow body. The pin cap includes a guide member that engages the aperture and a pin extending from the guide member to engage the outlet aperture of the tube. The pin cap is slidable within the aperture along the guide member to a first position in which the pin cap engages the outlet aperture to prevent fluid flow from the tube. The pin cap is further slidable within the aperture along the guide member to a second position in which the pin cap at least partially disengages from the outlet aperture to allow fluid to flow from the tube. A dispensing force may then be applied to cause fluid to flow through the outlet and application apertures and onto the surface to be glued.

In a fourth embodiment, a resilient biasing member engages the neck of the tube or other container at one end. A pin cap is disposed at the other end of the resilient biasing member. The pin cap engages the outlet aperture of the neck. Fluid is dispensed in a fashion similar to that set forth above with respect to the first embodiment.

In each of the foregoing embodiments, a guide slot may be disposed in the dispenser. The guide slot is used to hold the tube in a predetermined position with respect to the surface being glued as the glue is dispensed from the tube.

BRIEF DESCRIPTION OF THE DRAWINGS

FIG. 4 is a bottom view of the dispenser of FIG. 1.

FIG. 5 is a top view of a closure cap for use with the dispenser of FIG. 1.

FIG. 6 is a sectional side view of the closure cap of FIG. 5, taken along section line 6—6 of FIG. 5.

FIG. 7 is a side view of a wedge for use with the dispenser of FIG. 1.

FIG. 8 is a front view of the wedge of FIG. 7.

FIG. 9 is an end view of the biasing member of FIG. 1.

FIG. 10 is a side view of the hollow body of FIG. 1.

FIG. 11 is a side view of a bracket to hold the dispenser of FIG. 1 in an open position.

FIG. 12 is an axial sectional view of a second embodiment of the dispenser of the present invention.

FIG. 13 is an axial sectional view of the dispenser of FIG. 12 wherein the dispenser is provided with a viewing aperture.

FIG. 14 is a view of an alternate embodiment of a pin 26 of FIG. 1.

FIG. 15 is a an exploded view of a third embodiment of the dispenser of the present invention.

FIG. 16 is a top plan view of the dispenser of FIG. 15.

FIG. 17 is a sectional view of the dispenser of FIG. 15 taken along line 17—17 of FIG. 16.

DETAILED DESCRIPTION OF THE INVENTION

Figure 1:
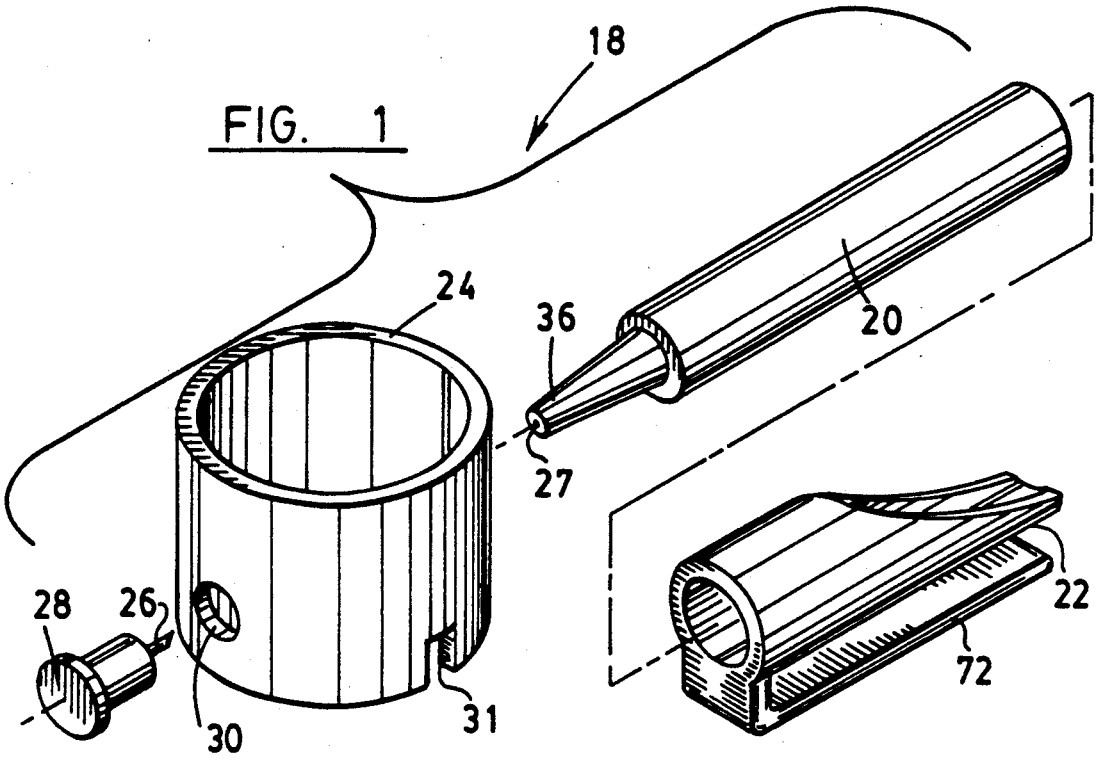
FIG. 1 is an exploded perspective view of a first embodiment of the dispenser of the present invention.

FIGS. 1–4 show a dispenser 18 including tube 20, hollow body 22, resilient biasing member 24 and pin cap 25. The hollow body 22 of FIG. 1 is typically sized to fit the tube 20 and to hold it in place by friction. It is also possible to attach a stop to the hollow body 22 to keep the tube 20 from falling out of the hollow body 22. This is a matter of design choice.

Pin cap 25 includes pin 26 which is connected to the resilient biasing member 24 by a pin holder 28 which is set in a hole 30 in the biasing member 24. In the alternative, the pin 26 could be inserted directly in the biasing member 24 or may be integral with the biasing member 24. Use of the pin holder 28 provides for a more positive alignment of the pin 26. The pin 26 pierces the neck 36 of the tube 20 to create an outlet aperture 27 through which fluid may flow.

Figure 2:
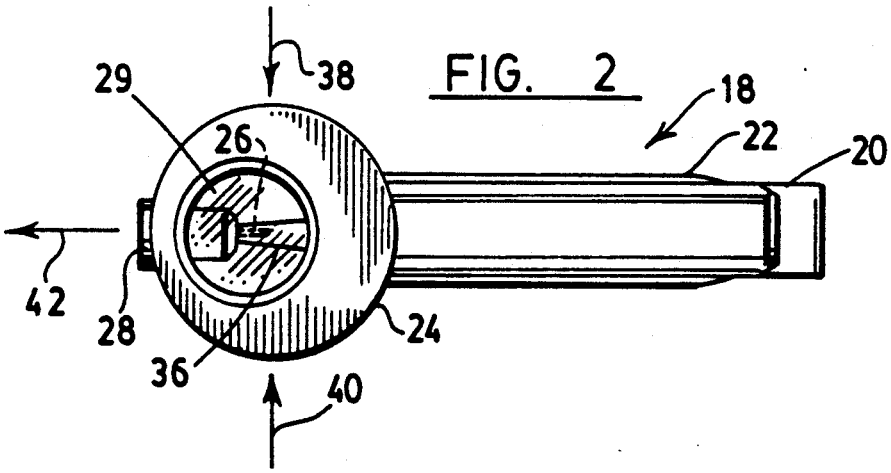
FIG. 2 is a top view of the dispenser of FIG. 1.

The biasing member 24 of the preferred embodiment is in the form of a cylindrical ring which is made of a material that is flexible enough to be squeezed and that is elastic enough to provide a restoring force. As shown in FIG. 1, the ring may have two open sides or, as shown in FIG. 2, one of the sides may be closed and provided with a magnifying lens 29 to allow the user to view the glue as it is dispensed from the tube 20. A guide slot 31 is provided on the biasing member 24 adjacent the outlet aperture 27 of the tube 20 to assist in applying the glue to a surface. The guide slot 31 can engage the edge of the surface to be glued to provide a stable sliding surface for the dispenser 18. Alternatively, the guide slot 31 may be located in an area other than in the area of the outlet aperture 27, in which case, a surface other than the surface to be glued can be engaged by the guide slot.

Although the components of the dispenser are shown as distinct parts, all of the various components that make up the dispenser may be constructed as a single integral unit made of a plastic material or the like. Similarly, only some of the several components may be integral with one another. For example, the tube 20 and hollow body 22 may be formed as a single unit. Likewise, it may be advantageous to construct the biasing member 24 and pin cap 25 as a single unit. These alternatives are all a matter of design choice.

Figure 3:
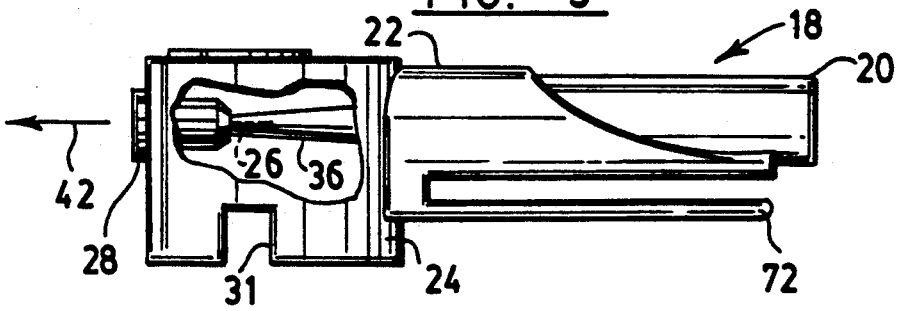
FIG. 3 is a partial cutaway side view of the dispenser of FIG. 1.
Figure 18:
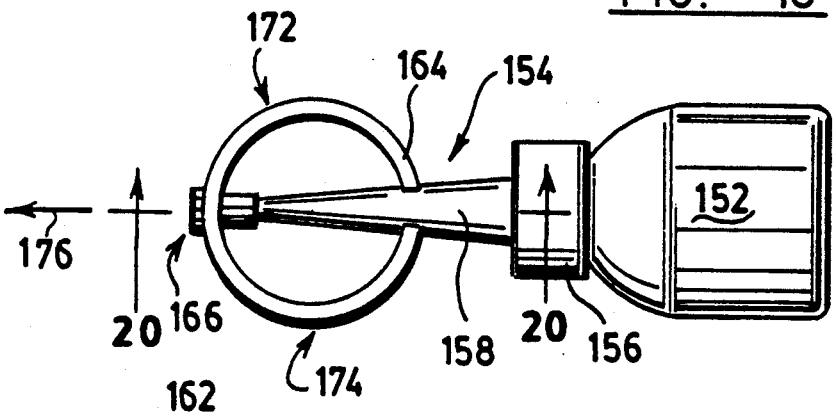
FIG. 18 is a top plan view of a resilient biasing member and pin cap as applied directly to the neck of a container of glue.
Figure 19:
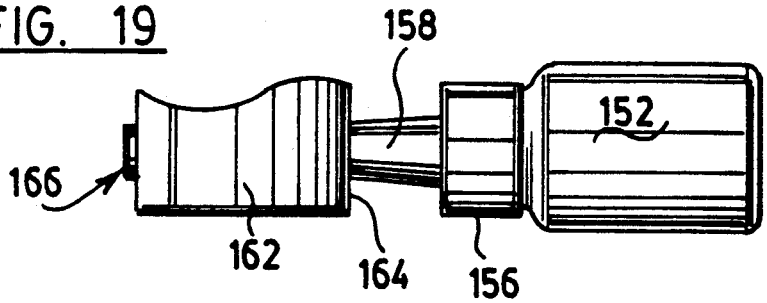
FIG. 19 is side view of the resilient biasing member, neck and pin cap of FIG. 18.
Figure 20:
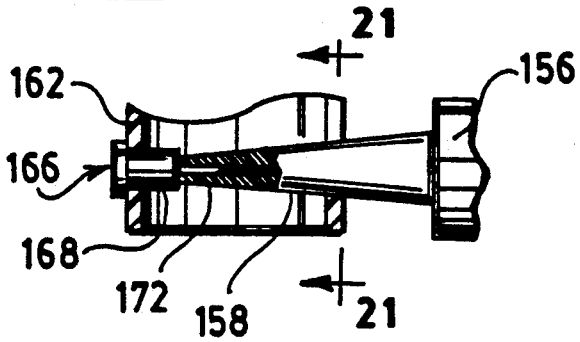
FIG. 20 is a sectional side view of the resilient biasing member, neck and pin cap as taken along line 20—20 of FIG. 18.
Figure 21:
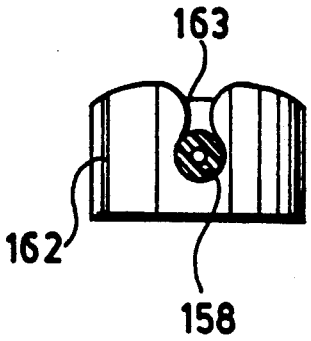
FIG. 21 is cross-sectional view of the resilient biasing member and neck taken along line 21—21 of FIG. 18.

Referring to the assembled views of FIGS. 2–4, the biasing member 24 is shown in its relaxed state. In this state, the biasing member 24 urges the pin 26 into the outlet aperture 27 of the neck 36 of the tube 20 so as to seal the tube 20 and prevent the escape of fluid. When an activating force is applied in the direction of arrows 38 and 40, the biasing member 24 is pinched so as to exert a force in the direction indicated by arrow 42. The pin 26 is moved with respect to the tube 20 in a direction indicated by the arrow 42. This pulls the pin 26 out of the neck 36, permitting fluid to escape if the tube 20 is pinched, squeezed, or poured. When the forces on the biasing member 24 are released, the elasticity of the biasing member 24 exerts a force so that the pin 26 is reinserted in the neck 36 automatically to seal the tube 20.

The tube 20 of FIGS. 1–4 may be supplied as a separate unit from the remaining components of the dispenser, or it may be applied as a part of the manufacturing process of making a tube 20 of super glue or the like ready for sale. If the tube 20 is applied in the manufacturing process, it will be useful to have something to keep the biasing member 24 from being pressed in the direction of the arrows 38 and 40 by inadvertent contact in shipping of the like. FIG. 5 is a top view of a closure cap 48 for use with the dispenser 18 of FIG. 1, and FIG. 6 is a sectional side view of the closure cap 48 of FIG. 5, taken along section line 6—6 of FIG. 5. In FIGS. 5 and 6, a lip 50 is sized to fit over the biasing member 24. The lip 50 is held in place by a surface 52 that provides structural support to the biasing member 24, preventing the biasing member 24 from being squeezed and thus holding the pin 26 in the tube 20 to seal the tube 20 until the closure cap 48 is removed to make the dispenser 18 ready for use.

FIG. 7 is a wedge 54 for use with the biasing member 24 of FIG. 1, and FIG. 8 is a side view of the wedge 54 of FIG. 7. In FIGS. 7 and 8, sides 56 and 58 are inclined toward each other to form a wedge 54 that fits inside the biasing member 24 of FIGS. 1–4. A slot 60 fits over the neck 36 of the tube 20, allowing the wedge 54 to be wedged into the biasing member 24 as an alternative method of keeping the biasing member 24 from being pinched to pull the pin 26 and spill glue.

FIG. 9 is an end view of the biasing member 24 of FIG. 1, and FIG. 10 is a side view of the hollow body 22 of FIG. 1. In FIG. 9, a hole 66 is sized to fit the outside 68 of the hollow body 22 of FIG. 10. A slot 70 in the biasing member 24 of FIG. 9 is located to receive a clip 72 of FIG. 10. The clip 72 is also useful as a pocket clip for carrying the dispenser 18 of the present invention in a shirt pocket or the like.

FIG. 11 is a view of a bracket 74 that is usable to hold the biasing member 24 of FIG. 1 in the squeezed or open position. A dimension 75 is made to equal the distance across the biasing member 24 when the biasing member 24 is being squeezed so as to pull the pin 26 of FIG. 1. To keep the pin 26 withdrawn so fluid will flow when the tube 20 is squeezed, the user pinches the biasing member 24 enough to slip the bracket 74 on the spot that is squeezed. To apply fluid, the user need only pinch the tube 20. When the job is done, the user can remove the bracket 74 to reseal the tube 20.

FIGS. 12 and 13 are axial sectional views of a second embodiment of the dispenser of the present invention. In FIGS. 12 and 13, a pin 78 is secured in a pin holder 80 to form a pin cap 81 that is secured in a hollow body 82. A tube of glue or the like, which is not shown here, is placed in an opening 84 in the hollow body 82 and is slid into the pin 78 so that the pin 78 pierces the neck of the tube to create any outlet aperture. A cutout 86 provides an application aperture for glue to drip from the tube of glue or the like when it is slid back on the pin 78. In the embodiment of FIG. 11, a wall 88 blocks a view from the side opposite to the cutout 86, so the user would have to look at the cutout 86 from the side when the dispenser 76 was turned over to apply glue or the like. In FIG. 13, a hole 90 provides a view from the top when the dispenser 76 is turned over to apply glue. A pocket clip 92 may be added as shown to enable the user to carry a tube of glue with a dispenser 76 in a pocket for extra convenience.

FIG. 14 is a view of an alternate embodiment of a pin 26 of FIG. 1. In FIG. 14, the pin 26 includes a tapered region 96 inserted into the neck 36 of the tube 20 of FIG. 1. A projection 98 is attached to the pin 26 to serve as a wick, conducting droplets of fluid from the tube 20 to a location on a work piece that may be more precise than could be achieved easily by letting the droplets fall. The projection 98 also makes it possible to spread liquid that has been applied to a work surface over a larger area than it might occupy as a result of having dripped. This aids in applying a thinner coat of a substance such as a super glue, which tends to make it more effective in use.

FIGS. 15–17 show a third embodiment of a dispenser. The dispenser includes hollow body 102, tube 20 and pin cap 106.

The hollow body 102 may be constructed from a plastic material or the like as two separate half shells 108, 110 which are connected together via, e.g., snap lock assemblies (not shown). Each half shell 108, 110 includes a tube grip 112 and a stop 114 to hold the tube 20 in a fixed position within the hollow body 102. Slots 116 are provided in surfaces 118, 120 to make the hollow body resiliently deformable. The hollow body is resiliently deformable to allow application of a dispensing force to the tube along arrows 122, 124. Open regions 126, 128 are disposed in the hollow body proximate the neck 36 of tube 20. When fluid is dispensed from the dispenser, one open region serves as an application aperture from which fluid may flow onto the surface that is to be glued while the other open region simultaneously serves as a viewing aperture to allow the user to view the fluid as it is dispensed from the tube 20. These open regions can be dimensioned to serve as guide slots.

Pin cap 132 includes pin 134 and a pin holder which includes a guide cylinder .136 which is dimensioned to slide within pin cap aperture 138 of hollow body 102. Stop flanges 142, 144 are disposed at each end of the guide cylinder 136 to retain the guide cylinder within the pin cap aperture 138.

As shown, pin 134 pierces neck 36 of tube 20 to form an outlet aperture through which fluid may flow. FIG. 17 shows the pin engaging the outlet aperture to seal the tube 20 to prevent fluid flow. To dispense fluid, the user grips stop flange 142 and applies a force in the direction of arrow 146. The pin cap 132 slides in the direction of arrow 146 along the guide cylinder 136 and pin cap aperture 138 until further motion is prevented by stop flange 144. In this second position, pin 134 is withdrawn from the outlet aperture a sufficient amount to allow fluid to flow from the tube 20.

FIGS. 18–21 show a fourth embodiment of the dispenser. The dispenser includes bottle 152 and bottle top 154. Bottle top 154 includes a threaded cap 156 and neck 158 extending from the threaded cap 156. A resilient biasing member 162 includes a slotted aperture 163 which engages neck 158. Neck 158 may be held in fixed alignment with end 164 of biasing member 162 through friction. Alternatively, neck 158 may be provided with flanges or a groove to engage end 164 of the biasing member 162.

A pin cap 166 is disposed through an aperture of the resilient biasing member 162. The pin cap includes pin holder 168 and pin 172 which pierces and seals the outlet aperture of neck 158. It should be noted that the neck 158, biasing member 162, and pin cap 166 can be constructed as a single integrated structure if desired. This decision remains a matter of design choice.

Operation of the dispenser is substantially similar to the operation of the first embodiment described above. When an activating force is applied in the direction of arrows 172 and 174, the biasing member 162 is pinched so as to exert a force in the direction indicated by arrow 176. The pin 172 is moved with respect to the bottle 152 in a direction indicated by the arrow 172. This pulls the pin 172 out of the neck 158 a sufficient distance to permit fluid to escape if the bottle 152 is pinched, squeezed, or poured. When the forces on the biasing member 162 are released, the elasticity of the biasing member 162 exerts a force so that the pin 172 is reinserted in the neck 158 automatically to seal the bottle 152. The biasing member 162 can be provided with a guide slot in the same manner as shown and described above with respect to the first embodiment of the dispenser.

While the dispensers of the present invention have particular advantages when they are used to dispense a super glue containing cyanoacrylate from a cylindrical plastic tube, it should be evident that the dispensers can be equally as well applied to dispense other fluids from storage media such as collapsible tubes that can be sealed with a pin. Tubes containing cyanoacrylate glue are typically cylindrical plastic tubes which may be made of polyethylene or the like. Collapsible tubes of other plastics or of metal could also be used. It has been noted that one advantage of the dispenser of the present invention is the fact that they apply a force to withdraw a pin that may be stuck in the neck of a tube of glue while keeping the fingers of a user at some distance from the open neck of a tube. The ability to apply a substantial force to withdraw the pin can be an advantage even in dispensing substances that have less tendency to solidify and grip the pin securely than does super glue. However, many other fluids such as cements, syrups, and the like solidify upon exposure to the air and tend to make it difficult to withdraw a sealing pin.

The embodiments of the invention shown here are intended to enable the practice of the best mode of the invention that is known to the inventor. They should be taken as illustrative and not as limiting, and the scope of the invention should be limited only by the scope of the appended claims and their equivalents.

I claim:

1. A dispenser to be connected to a container having a neck, said container containing a fluid that is dispensed by making a pinhole in seal of said neck, said pinhole forming an outlet aperture for fluid flow from said tube, said dispenser comprising:

a pin;

means for supporting said pin in an inserted position in said outlet aperture, said means for supporting said pin further providing means for retracting said pin an amount sufficient to pass droplets of said fluid, said means for supporting also providing means for automatically returning said pin to said inserted position in said outlet aperture.

2. The dispenser of claim 1 wherein said means for supporting said pin comprises:

a resilient biasing member having a plurality of flexible sides that flex when squeezed to elongate said biasing member and thereby retract said pin and that exert a restoring force to return said biasing member to a position in which said pin is in said outlet aperture upon not being squeezed.

3. The dispenser of claim 2 comprising in addition a hollow body connected to said resilient biasing member and sized to receive and support said container.

4. A dispenser for accepting a container having a neck, said container containing a fluid that is dispensed by making a pinhole in a seal in said neck, said pinhole forming an outlet aperture for fluid flow from said tube, said dispenser comprising:

a hollow body for holding said container, said hollow body having an application aperture in the region of said hollow body proximate said outlet aperture of said container;

pin cap disposed in an aperture within said hollow body, said pin cap having a guide member that engages said aperture and a pin extending from said guide member to engage said outlet aperture of said container, said pin cap being slidable within said aperture along said guide member to a first position in which said pin engages said outlet aperture to prevent fluid flow from said container, said pin cap being further slidable within said aperture along said guide member to a second position in which said pin at least partially disengages from said outlet aperture to allow fluid to flow from said container.

5. A dispenser as claimed in claim 4 wherein said hollow body includes slots in a surface thereof to make said hollow body resiliently deformable.

6. A dispenser as claimed in claim 4 and comprising in addition a tube grip and a stop disposed in said hollow body for holding a tubular container within said hollow body.

7. A dispenser as claimed in claim 4 wherein said guide member is cylindrical.

8. A dispenser as claimed in claim 4 wherein said guide member includes stop flanges to limit said range of movement of said pin cap.

9. A dispenser as claimed in claim 4 and comprising in addition a wick connected to said pin cap to conduct fluid to a surface that is to receive said fluid.

10. A dispenser as claimed in claim 4 wherein said hollow body comprises two half shells.

11. A dispenser as claimed in claim 10 wherein said two half shells are connected to one another by snap-lock assemblies.

12. A dispenser as claimed in claim 4 wherein said hollow body includes a guide slot.

13. A dispenser as claimed in claim 12 wherein said application aperture is dimensioned to function as said guide slot.

14. A dispenser for accepting a container having a neck, said container containing a fluid that is dispensed by making a pinhole in a seal in said neck, said pinhole forming an outlet aperture for fluid flow from said container, said dispenser comprising:

a hollow body for holding said container, said hollow body having means for allowing application of a dispensing force to said container;

a pin cap having a pin extending therefrom to engage said outlet aperture of said tube;

resilient means for biasing said pin cap in a first position in which said pin engages said outlet aperture to prevent fluid flow from said tube, application of an activating force to said resilient means causing said resilient means to urge said pin cap to a second position in which said pin at least partially disengages from said outlet aperture to allow fluid to flow from said tube.

15. A dispenser as claimed in claim 14 wherein said means for allowing application of a dispensing force to said container comprises a substantially open region disposed in said hollow body that is of sufficient size to allow a user to apply a dispensing force directly to said container.

16. A dispenser as claimed in claim 14 and comprising in addition a wick connected to said pin cap to conduct fluid to a surface that is to receive said fluid.

17. A dispenser as claimed in claim 14 and comprising in addition protective means for preventing application of an activating force to said resilient means.

18. A dispenser as claimed in claim 14 and comprising in addition a clip connected to said hollow body.

19. A dispenser as claimed in claim 14 wherein said resilient means comprises an elastically deformable ring having a first side connected to said holder, said neck of said container extending through said first side and into an interior portion of said ring, said ring having a second side connected to said pin cap to hold said pin in said outlet aperture.

20. A dispenser as claimed in claim 19 wherein said ring further comprises a magnifying lens disposed in an open side of said ring.

21. A dispenser as claimed in claim 19 wherein said ring further comprises a guide slot.

22. In a container for holding a fluid that is dispensed by making a pinhole in a seal in a neck of said container, said pinhole forming an outlet aperture for fluid flow from said container, the improvement comprising:

a pin extending to engage said outlet aperture in said neck;

resilient means for biasing said pin in a first position in which said pin engages said outlet aperture to prevent fluid flow from said container, application of an activating force to said resilient means causing said resilient means to urge said pin to a second position in which said pin at least partially disengages from said outlet aperture to allow fluid to flow from said tube.

23. A dispenser as claimed in claim 22 and comprising in addition protective means for preventing application of an activating force to said resilient means.

24. A dispenser as claimed in claim 22 and comprising in addition means for maintaining said activating force on said resilient means.

25. A dispenser as claimed in claim 22 and comprising in addition a wick connected to said pin to conduct fluid to a surface that is to receive said fluid.

26. A dispenser as claimed in claim 22 wherein said resilient means comprises an elastically deformable cylindrical ring having a first side connected to said neck, said neck extending into an interior portion of said ring, said ring having a second side in fixed alignment with said pin to hold said pin in said outlet aperture.

27. A dispenser as claimed in claim 26 wherein said first side of said ring is held in fixed alignment with said neck by a flange.

28. A dispenser as claimed in claim 26 wherein said ring further comprises a guide slot.

29. A dispenser as claimed in claim 26 wherein said ring further comprises a magnifying lens disposed in an open side of said ring.

30. A dispenser for accepting a container having a neck, said container containing a fluid that is dispensed by making a pinhole in a seal in said neck, said pinhole forming an outlet aperture for fluid flow from said tube, said dispenser comprising:

a hollow body for holding said container, said hollow body having an application aperture in the region of said hollow body proximate said outlet aperture of said container;

a pin connected within said hollow body, said pin engaging said outlet aperture of said container, said container being slidable within said hollow body to a first position in which said pin engages said outlet aperture to prevent fluid flow from said container, said container being further slidable within said hollow body to a second position in which said pin at least partially disengages from said outlet aperture to allow fluid to flow from said container.

31. A dispenser as claimed in claim 30 and comprising in addition a wick connected to said pin to guide fluid to a surface that is to receive said fluid.

32. A dispenser as claimed in claim 30 wherein said hollow body includes a guide slot.

33. A dispenser as claimed in claim 32 wherein said application aperture is dimensioned to function as said guide slot.

* * * * *